United States Patent [19]

Jarry

[11] 4,098,239

[45] Jul. 4, 1978

[54] VALVE CONTROL DEVICE PARTICULARLY IN AN OVERHEAD CAMSHAFT ENGINE

[75] Inventor: Philippe Jarry, Sevres, France

[73] Assignee: Le Moteur Moderne, Boulogne-Billancourt, France

[21] Appl. No.: 731,380

[22] Filed: Oct. 12, 1976

[30] Foreign Application Priority Data

Oct. 31, 1975 [FR] France ..... 75 33362

[51] Int. Cl.[2] ..... F01L 1/18; F01L 1/30; F01L 1/00

[52] U.S. Cl. ..... 123/90.44; 123/90.2; 123/90.24; 123/90.27; 123/90.46

[58] Field of Search ..... 123/90.44, 90.27, 90.46, 123/90.55, 90.45, 90.53, 90.24, 90.2, 90.41, 90.39, 90.26, 90.52, 90.25

[56] References Cited

U.S. PATENT DOCUMENTS

| | | | |
|---|---|---|---|
| 1,134,867 | 4/1915 | Keister | 123/90.39 |
| 1,494,217 | 5/1924 | Culverhouse | 123/90.44 |
| 2,827,888 | 3/1958 | Chadwell | 123/90.39 |
| 3,400,696 | 9/1968 | Thompson | 123/90.27 |
| 3,563,217 | 2/1971 | Bartels | 123/90.44 |
| 3,626,469 | 12/1971 | Ashley | 123/90.44 |
| 3,658,038 | 4/1972 | Bergmann | 123/90.27 |
| 3,791,355 | 2/1974 | Bergmann et al. | 123/90.44 |
| 3,875,908 | 4/1975 | Ayres | 123/90.44 |

FOREIGN PATENT DOCUMENTS

| | | | |
|---|---|---|---|
| 4,727,045 | 12/1969 | Japan | 123/90.44 |
| 1,298,869 | 12/1972 | United Kingdom. | |

*Primary Examiner*—Charles J. Myhre
*Assistant Examiner*—Sheldon Richter
*Attorney, Agent, or Firm*—Finnegan, Henderson, Farabow & Garrett

[57] ABSTRACT

A valve control device for an overhead camshaft engine including a rotatable cam interconnected through a rocker to a valve mounted for reciprocal movement from an open to a closed position. The valve is normally biased toward the closed position and engages the rocker at one end, the other end of the rocker directly engaging the cam. A hydraulic brake is connected to the rocker at its other end and retards movement of the valve toward the closed position.

5 Claims, 2 Drawing Figures

VALVE CONTROL DEVICE PARTICULARLY IN AN OVERHEAD CAMSHAFT ENGINE

The present invention concerns a valve control means, particularly for overhead cam-shaft engines of the type with a rotatable cam and transmission means cooperating with the cam to communicate to the valve a reciprocal lifting movement, aganist the force of a return member ensuring the re-seating of the valve, these transmission means having a rocker one of whose ends bears on the valve and a hydraulic brake for braking the movement thereof when said valve re-seats.

The hydraulic brake of control devices of this type cooperates directly with the cam, while its movement is communicated to the valve through the tranmission means. Its surface, which contacts the cam, must however be relatively large so that its cooperation therewith is carried out in good conditions. However, for such conditions to be fulfilled, its dimensions must be large, which has the disadvantage of making it heavy and cumbersome.

The present invention seeks to overcome this disadvantage and has as objective a valve control device of the above-mentioned type which is characterized in that the rocker cooperates directly with the cam by its other end, means being provided to ensure the connection thereof with the hydraulic brake.

With this arrangement, the hydraulic brake can now be of a smaller size since it is no longer in contact with the cam. The result is that its weight and overall dimension can be reduced while its effective braking surface can be increased.

In the particular case where the hydraulic brake comprises a push-rod which moves in a fluid-filled bore and which has at its upper end a projecting peripheral flange having a small space between it and the wall of the bore and contacting the base thereof when the valve is in its closed position, the control device of the invention is furthermore characterized in that said other end of the rocker passes between the walls of a clevis on the lower end of the push-rod, the connecting means being constituted by a shaft connecting the walls of the clevis and cooperating during the movement of the transmission elements with the opposing faces of a throat formed in said other end of the rocker.

It will be easily realised that the connection between the rocker and the hydraulic brake is simple and easy to form.

Preferably, the shaft connecting together the walls of the clevis has two flats cooperating with the opposing faces of the throat, which provides a larger contacting surface between the shaft and the rocker and therefore a better connection.

Advantageously, the control device comprises in addition means for adjusting the working clearance between the rocker and the cam.

Figure 2:
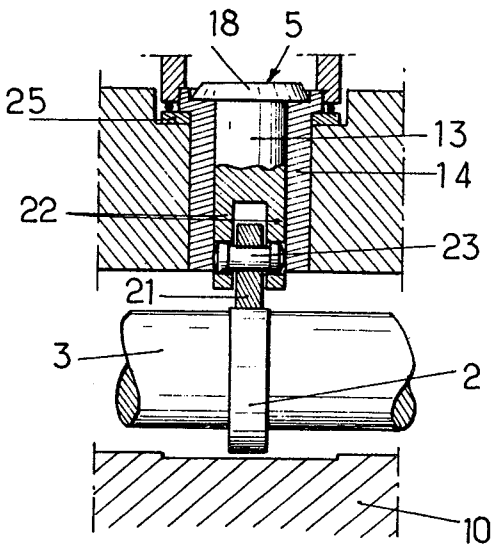
Figure 1:
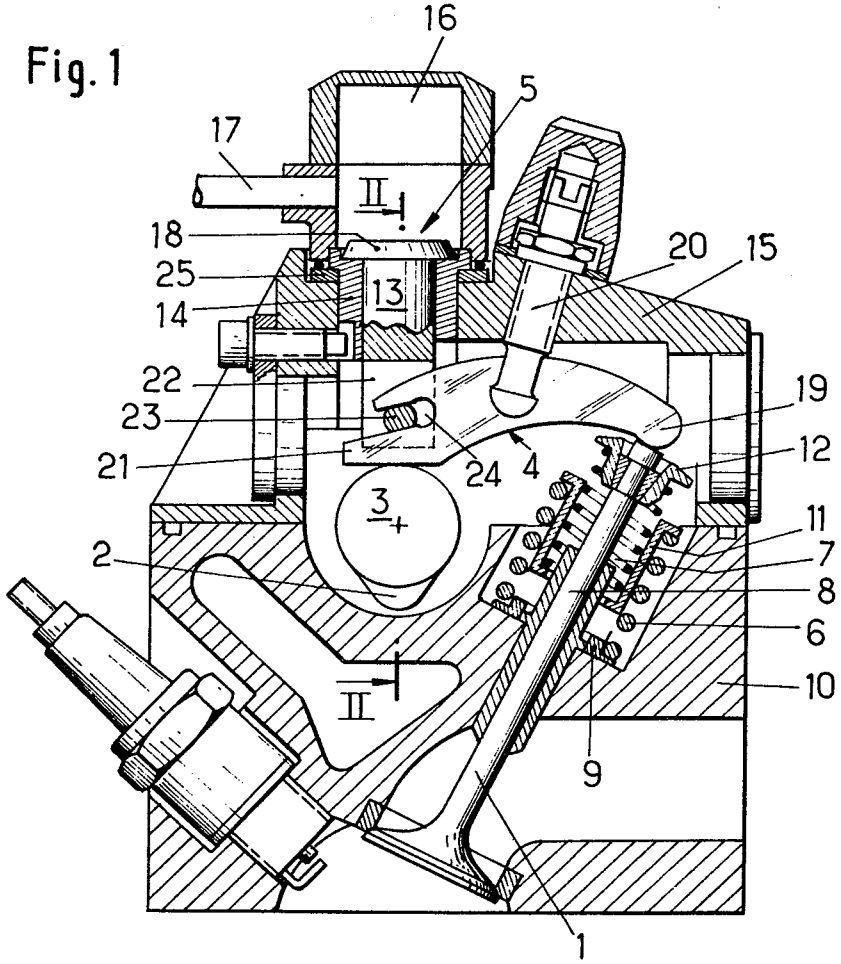

The invention will be better undestood from the description given below purely as an example, in conjunction with the accompanying drawings in which:

FIG. 1 is a sectional view of the divice according to the invention applied to the control of the intake valve of an explosion engine; and FIG. 2 is a sectional view taken on line II—II of FIG. 1.

The control device shown in the drawing has for example an intake valve 1, a rotatable cam 2 forming part of an overhead camshaft 3 and transmission means cooperating with the cam to communicate a reciprocal lifting movement to the valve, aganist the force exerted by a return means to ensure re-seating of the valve.

The transmission means comprise a rocker 4 and a hydraulic brake 5 for braking the movement thereof when the valve re-seats.

According to this embodiment, the return member for the valve is constituted in a known way by two springs 6 and 7 of different stiffness. These springs are helical springs mounted around the valve stem 8. Spring 6 is mounted between a fixed stop 9 integral with the cylinder head 10 and an annular member 11 movably mounted around valve-stem 8 whereas spring 7 is mounted between said member 11 and a stop 12 fixed to the end of the valve-stem.

The hydraulic brake is constitued also in a known way. It comprises a push-rod 13 which moves in a bore in a liner 14 provided in rocker box 15 and over which is located a volume 16 filled with a fluid, e.g. oil, supplied at 17 for example by recovering oil dropping from the cylinder head or by separate feed. At its upper end, the push-rod is provided with a peripheral flange 18 leaving a small space between its periphery and the wall of the bore and coming into contact with the base thereof when the valve is in the closed position. So as to provide, between the wall of the bore and the periphery of the flange, thin-wall hydraulic flow conditions for eliminating viscous effects, that face of the flange opposite the one contacting the base of the bore is bevelled.

It will moreover be noted that rocker 4 bears with one end 19 on the valve-stem and pivots on a swivle end shaft 20, the clearance between valve and rocker being advantageously adjustable by movement of shaft 20 which is threaded.

According to the invention, rocker 4 cooperates directly with cam 2 through a shoe provided on its other end 21, whereas connecting means are provided for connecting this end to the push-rod. Referring more particularly to FIG. 2, it can be seen that end 21 passes between the walls 22 of a clevis provided at the lower end of the push-rod and that the connecting means are formed by a shaft 23 connecting the walls of the clevis and cooperating during the movement of the rocker with the opposing faces of a throat 24 formed in end 21.

It can easily be seen that with such an assembly, the push-rod can have a much smaller section than those used in conventional control devices, which permits a reduction of its weight and overall dimension and an increase in its effective braking surface.

It will also be remarked that shaft 23 has two flats to ensure a greater contacting surface between it and the rocker.

Finally, it will also be noted that a shim 25 is placed between the liner 14 and the rocker box 15 for adjusting the working clearance between rocker and cam.

The operation of the control device which has been descirbed is known per se and does not call for a detailed description. It will simply be pointed out that during the lifting of valve 1, cam 2 lifts end 21 of the rocker, which communicates its movement to shaft 23 which, by moving slightly along opposing faces of throat 24, in its turn raises push-rod 13. Then, during reseating of the valve, and more exactly when it has re-seated, flange 18 nearing the base of the bore brakes the downward movement of the push-rod which, through shaft 23, brakes end 21 of the rocker in its movement approaching the cam.

It goes without saying that the control device of the invention could be equally applied to an exhaust valve.

What we claim is:

1. In an overhead camshaft engine including an engine head, the improvement which comprises a rotatable cam, at least one valve mounted for reciprocal movement in said engine head from an open to a closed position, a return member normally biasing said valve toward said closed position, a transmission interconnecting said cam and said valve and including a rocker pivotal about an axis, said rocker including first and second arms extending in opposite directions from said axis, said first arm bearing against said valve, said second arm having an end remote from said axis said end directly engaging said cam, and a hydraulic brake connected to said second rocker arm at said end to retard movement of said valve toward said closed position.

2. A device as defined in claim 1 and including means for adjusting the working clearance between said rocker and said cam.

3. A device as defined in claim 1 wherein said connection between said hydraulic brake and said rocker includes a clevis on one of said brake and receiving said end of said second rocker arm, a throat formed in said end of said second rocker arm and having opposing faces, a shaft on said brake extending into said throat and engaging said opposing faces.

4. A device as defined in claim 3 wherein said hydraulic brake includes a push-rod movable in a bore filled with a fluid, said push-rod having at its upper end a projecting peripheral flange leaving a small space between it and the wall of the bore and coming into contact with the base thereof when said valve is in the closed position.

5. A device as defined in claim 3 wherein the shaft connecting the walls of the clevis to said rocker has two flats cooperating with the opposing faces of the throat.

* * * * *